US005585822A

United States Patent [19]

Nishikawa

[11] Patent Number: 5,585,822

[45] Date of Patent: Dec. 17, 1996

[54] DISPLAY CONTROL APPARATUS

[75] Inventor: Hirofumi Nishikawa, Hamura, Japan

[73] Assignee: Kabushiki Kaisha Toshiba, Kanagawa-ken, Japan

[21] Appl. No.: 517,587

[22] Filed: Aug. 22, 1995

Related U.S. Application Data

[63] Continuation of Ser. No. 117,053, filed as PCT/JP92/00614, May 14, 1992 published as WO93/05469, Mar. 18, 1993, abandoned.

[30] Foreign Application Priority Data

Sep. 12, 1991 [JP] Japan ..... 3-233217

[51] Int. Cl.[6] ..... G09G 1/28

[52] U.S. Cl. ..... 345/150; 345/141; 345/114

[58] Field of Search ..... 345/114, 150, 345/118, 141, 146, 186; 395/131; 348/587, 589, 591, 592

[56] References Cited

U.S. PATENT DOCUMENTS

| | | | |
|---|---|---|---|
| 4,310,838 | 1/1982 | Juso et al. | 345/186 |
| 4,835,526 | 5/1989 | Ishii | 345/150 |
| 4,924,299 | 5/1990 | Miguno et al. | 345/113 |
| 5,039,983 | 9/1991 | Yoon | 345/114 |

FOREIGN PATENT DOCUMENTS

| | | | |
|---|---|---|---|
| 1200631 | 2/1986 | Canada | 345/150 |
| 0104724A3 | 4/1984 | European Pat. Off. . | |
| 0271952 | 6/1988 | European Pat. Off. . | |
| 53-124036 | 10/1978 | Japan | 345/150 |
| 61-292781 | 12/1986 | Japan . | |
| 62-170997 | 7/1987 | Japan . | |
| 63-99691 | 4/1988 | Japan . | |
| 64-79790 | 3/1989 | Japan . | |
| 64-88627 | 4/1989 | Japan . | |
| 2-93587 | 4/1990 | Japan | 345/114 |
| 2-144596 | 6/1990 | Japan . | |
| 5-257439 | 10/1993 | Japan | 345/150 |
| 1056260 | 10/1983 | U.S.S.R. | 345/114 |

OTHER PUBLICATIONS

IBM Technical Disclosure Bulletin 30(10):46. Mar. 1988.

IBM Technical Disclosure Bulletin, Local Processing of F4 Pop-up Window, vol. 33, No. 6B, pp. 348–350, Nov. 1990.

*Primary Examiner*—Raymond J. Bayerl

*Assistant Examiner*—Doon Chow

*Attorney, Agent, or Firm*—Finnegan, Henderson, Farabow, Garrett & Dunner, L.L.P.

[57] ABSTRACT

A display control apparatus makes it possible to display a window on a display screen. The apparatus includes a display memory 21 for storing display data, a reading section 25 for reading the display data from the display memory, a color generating section (24 and 28) for generating color-designating data in accordance with the display data, a display for displaying the color-designating data on the display screen, and a data changing section for changing the color-designating data generated by the color generating section (24 and 28) to different color-designating data, when the color displayed on the display screen by the display is identical to the color of the window displayed, to thereby alter the color of the window.

12 Claims, 5 Drawing Sheets

VRAM 21
(APPLICATION)

| FONT CODE | BACKGROUND COLOR | CHARACTER COLOR |
|---|---|---|
| 41 | 0 | 6 |
| 42 | 0 | 7 |

FIG. 3(a)

(POPUP MENU)

| FONT CODE | BACKGROUND COLOR | CHARACTER COLOR |
|---|---|---|
| 41 | 0 | 7 |

FIG. 3(b)

PALETTE REGISTERS 24

| INDEX | DATA |
|---|---|
| 0 | 0 (0) |
| - - - - | - - - - |
| 6 | 6 |
| 7 | 0 (7) |
| - - - - | - - - - |
| F | |

FIG. 3(c)

VIDEO DAC 30
(COLOR REGISTERS)

| INDEX | DATA |
|---|---|
| 0 | 0 (0) |
| - - - - | - - - - |
| 6 | 2F |
| 7 | 0 (3F) |
| - - - - | - - - - |
| FF | |

FIG. 3(d)

DISPLAY CONTROL APPARATUS

This is a continuation of application Ser. No. 08/117,053, filed as PCT/JP92/00614, May 14, 1992 published as WO93/05469, Mar. 18, 1993, now abandoned.

The present invention relates to a popup menu control on a personal computer.

BACKGROUND ART

Battery-driven personal computers support a popup menu function.

Any item the user of a personal computer has set or changed in the popup menu is stored as a computer-system configuration in a battery backed-up CMOS RAM, even if the user does not turn off the power switch or perform resetting (reboot). In other words, menu items can be changed without turning off the power switch or performing reboot (re-reboot).

The popup menu function achieves, for example, the gradation control for the built-in display, the ON/OFF setting of the battery and the system speaker, the power ON/OFF control of the built-in modem, and the setting of the AUTO OFF time for the HDD (Hard Disk Drive).

The popup menu is activated when a specified key on the keyboard is depressed and is displayed on the display.

Most of battery-driven personal computers support a VGA (Video Graphics Array) which is a display-controlling means. The VGA includes palette registers for storing color-designating data.

The VGA comprises an EGA (Enhanced Graphics Adapter), color registers, and D/A converters for performing D/A conversion on the values held in the color registers.

The 400-line scheme is standard for the VGA, whereas the 350-line scheme is standard for the EGA. The VGA can provide high resolution of 640×480. This makes analog display possible, in which 256 colors can be selected from 262144 colors, instead of selecting 16 colors from 64 colors in the EGA.

Hitherto, only the data in the VRAM is rewritten before displaying the popup menu on the display screen. This measure is taken in order not to change the condition (color) in which to display the popup menu on the display screen.

In some applications, the values set for the palette registers and the color registers, both used to display characters of the popup menu, are identical to the values set for the palette registers and the color registers, both used to display screen background (screen-background color). If this is the case, the popup menu characters and the screen background will be displayed in the same color. Consequently, the popup menu will not be seen on the screen.

DISCLOSURE OF INVENTION

In view of the foregoing, it is an object of the present invention to provide a display control apparatus wherein, when a popup menu cannot be seen or is hard to see, the values set for the palette registers and the color registers can be changed, to thereby display the popup menu clearly.

The display control apparatus according to this invention makes it possible to display a window on a display screen. The apparatus is characterized by comprising: a display memory for storing display data; a reading section for reading the display data from the display memory; a color-generating section for generating color-designating data in accordance with the readout display data; a display for displaying the color-designating data on the display screen; and a data-changing section for changing the color-designating data generated by the color-generating section to a different color-designating data, when the color displayed on the display screen by the display is identical to the color of the window displayed, to thereby alter the color of the window.

In the display control apparatus of the structure described above, the reading section reads the display data from the display memory in order to display the window.

The color-generating section generates color-designating data in accordance with the display data. The display displays data in the color designated by the color-designating data generated by the color-generating section.

When the background color and character color of the window displayed by the display are identical, the data-changing section changes the color-designating data generated by the color-generating section to a different color-designating data, to thereby alter the character color of the window.

As described above, the color in which the popup menu is displayed is changed and made different from the color of the display screen. This helps to enhance the use efficiency of a computer.

BRIEF DESCRIPTION OF DRAWINGS

FIG. 3 is a diagram illustrating data items stored in the VRAM, palette registers and video DAC of the VAG;

DETAILED DESCRIPTION OF THE INVENTION

A personal computer, to which an embodiment of the present invention is applied, will now be described with reference to the accompanying drawings.

Figure 1:
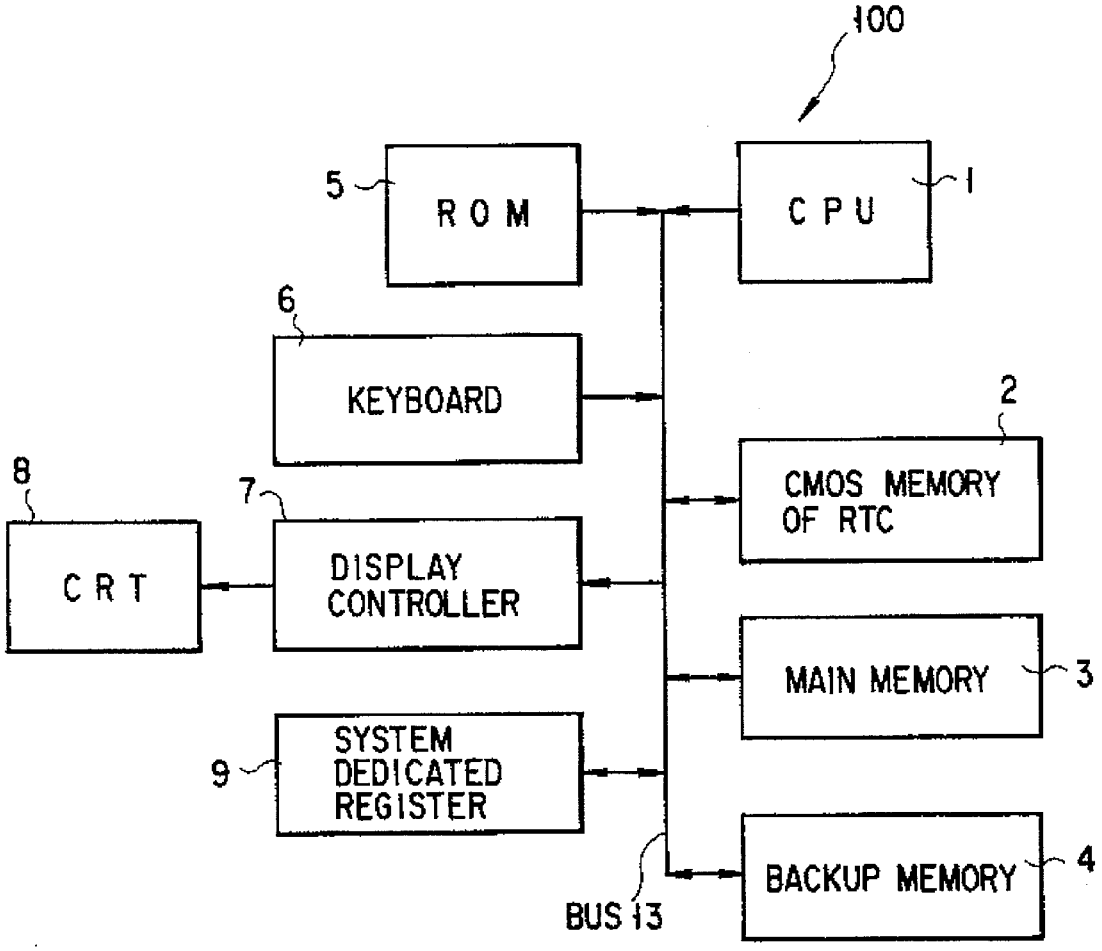
FIG. 1 is a block diagram of a personal computer to which an embodiment of the invention is applied.
Figure 2:
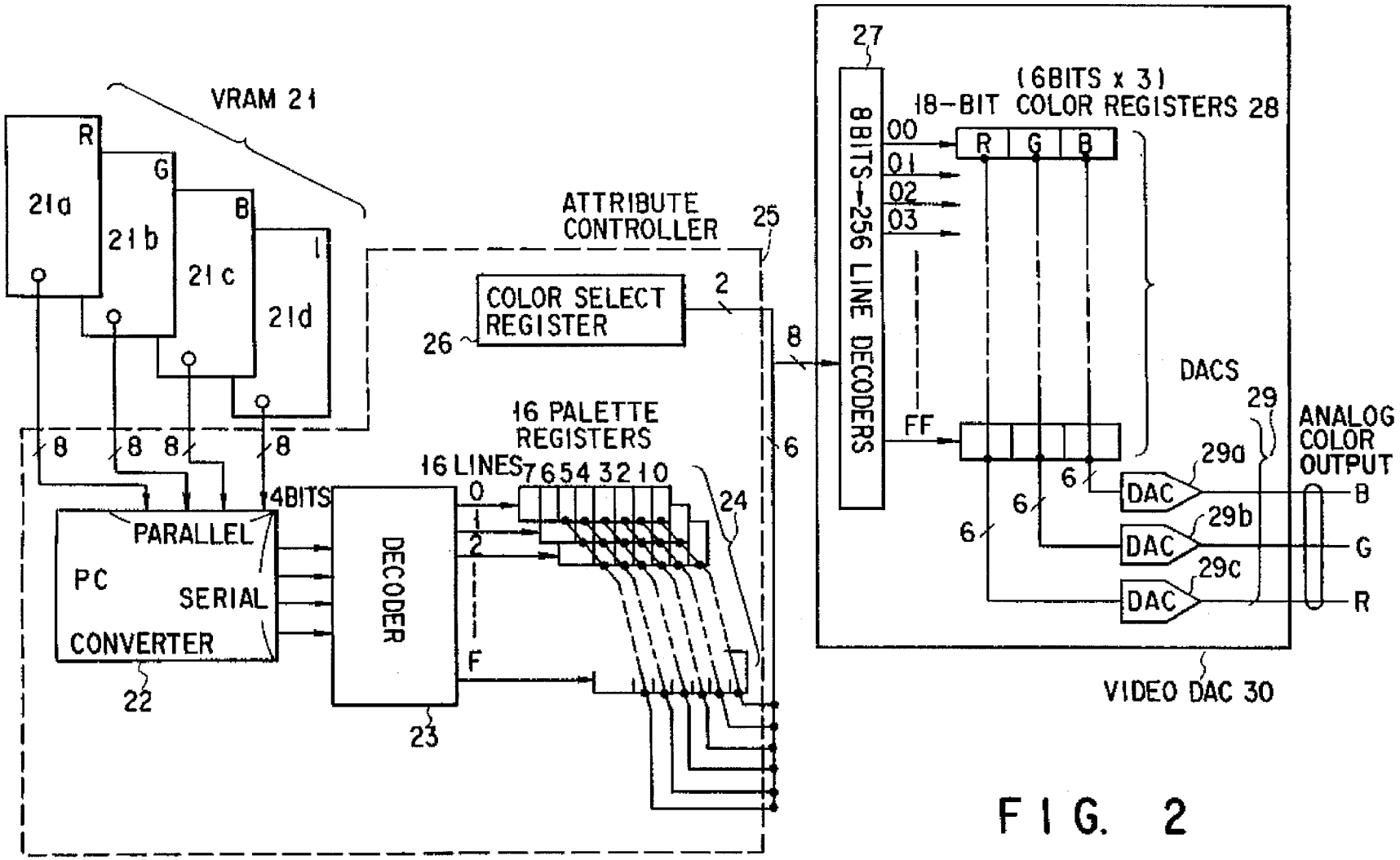
FIG. 2 is a block diagram of a VGA incorporated in the personal computer shown in FIG. 1.

FIG. 1 is a block diagram showing a personal computer 100 to which an embodiment of the invention is applied. FIG. 2 is a block diagram showing an arrangement of the VGA incorporated in the personal computer 100.

The structure of the personal computer 100 will be described first.

The personal computer 100 has a CPU 1, a CMOS memory 2 of RTC (Real Time Clock), a main memory 3, a backup memory 4, a ROM 5, a keyboard 6, a display controller 7, a CRT 8, a system dedicated register 9, and a bus 13.

The CPU 1, the CMOS memory 2 of RTC, the main memory 3, the backup memory 4, the ROM 5, the keyboard 6, the display controller 7, and the system dedicated register 9 are connected to one another by the bus 13. The CRT 8 is connected to the display controller 7.

The CPU 1 controls the entire personal computer in accordance with the program stored in the ROM 5.

The CMOS memory 2 of RTC is a memory backed-up by a battery. It stores various values set by the user for the popup menu.

The main memory 3 stores the data used to execute the system program, application programs, and the like.

The backup memory 4 stores the data of the initial screen (display data), while the popup menu is being displayed.

The ROM 5 is a system BIOS ROM storing the system control programs including the popup menu control program.

The keyboard 6 is a device for inputting data when operated.

The display controller 7 controls the display operation of the CRT 8 and causes the VGA (Video Graphics Array).

The system dedicated register 9 is connected directly to a prescribed port of the keyboard 6 (in this case, to an output port for outputting data representing the activation/termination of the popup menu).

When the Ctrl key, the Alt key, and the SysReq key are depressed to designate the activation/termination of the popup menu after data from the keyboard 6 has been stored, a signal representing the depression of these keys is supplied to the system register 9. The signal is stored at predetermined bits of the system register.

The key for requesting for a change in the display color is exclusively the Fn key. Hence, the CPU and the keyboard can communicate with each other, without using the system dedicated register 9.

The structure of the display controller 7 will now be described, with reference to FIG. 2.

The display controller 7 shown in FIG. 2 has a VRAM 21, an attribute controller 25, and a video DAC (DA converter) 30.

The VRAM 21 is constituted by four memory planes 21*a*, 21*b*, 21*c*, and 21*d*, and designed to store display data (including display screen data, color-designating data, and the like).

In a graphics mode, the memory plane 21*a* stores data representing the red-display gradation of each pixel, the memory plane 21*b* stores data representing the green-display gradation, the memory plane 21*c* stores data representing the blue-display gradation, and the memory plane 21*d* stores data representing intensity.

In a text mode, only one of the four memory planes 21*a*, 21*b*, 21*c*, and 21*d* is used to store font codes and attribute data. The attribute data includes 8-bit data representing the background color for characters defined by the font code, and 8-bit data representing the color of the characters.

FIG. 3(*a*) illustrates an example of the data stored in the VRAM 21 by an application program. They are: a font code "41" (representing letter A), color data "0" representing a background color, and data item "6" representing a character color. FIG. 3(*b*) shows an example of data stored in the VRAM 21 for displaying a popup menu. They are: the font code "41", a color data item "0" representing the background color, and a data item "7" representing a character color.

The attribute controller 25 is comprises of a PS converter 22, a decoder 23, a group 24 of palette registers, and a color select register 26.

In the graphics mode, 8-bit signals are supplied to the PS converter 22 from the VRAMs 21*a*, 21*b*, 21*c*, and 21*d*. The PS converter 22 converts the parallel signals to 4-bit serial signals and output these 4-bit signals.

In the text mode, an 8-bit signal designating the background color or an 8-bit signal designating a character color is supplied from the VRAM 21 to the PS converter 22. The PS converter 22 outputs the signal it has received.

The decoder 23 decodes the data output from the PS converter 22 and activates one of the 16 output terminals, thereby selecting one of the palette registers of the group 24. Indices O to F are assigned to the palette registers, respectively.

The color select register 26 alternately designates color registers, and holds 2-bit data for instantaneously change the color. More precisely, the 256 color registers incorporated in the video DAC 30 are divided into four color-register blocks each consisting of 64 color registers (four groups, each consisting of 64 colors). One of the four blocks is selected in accordance with the 2 bits output from the color select register 26. Thus, all the 256 color registers need not be rewritten every time it is necessary to alter color. It suffices to switch the blocks, in order to alter color. A selector is used to select either the upper two of the 8 bits output from the palette register 24 or the upper two of the 8 bits output from the color select register 26, which are used as the upper two of the 8 bits to be supplied to the video DAC 30.

The video DAC 30 comprises a line decoder 27, a group 28 of color registers, and a group 29 of DACs.

Data of 8 bits are supplied to the line decoder 27. Of these 8 bits, two bits are supplied from the color select register 26, and the remaining six bits are supplied from the group 24 of palette registers. The line decoder 27 decodes the 8-bit data, thereby selecting one of the color registers forming the group 28.

The group 28 of color registers comprises 256 18-bit color registers. Indices O to FF are assigned to these color registers.

FIG. 3(*d*) illustrates an example of data stored in the color registers in accordance with an application program. Each color register stores at its upper six bits the data representing the red-display gradation, and at its intermediate six bits the data representing the green-display gradation, and at its lower six bits the data representing the blue-display gradation.

The group 29 of DACs consists of three DACs 29*a*, 29*b*, and 29*c*. The 6-bit data stored at the upper bits of the color register are supplied to the DAC 29*c*. The 6-bit data stored at the intermediate bits of the color register are supplied to the DAC 29*b*. The 6-bit data stored at the lower bits of the color register are supplied to the DAC 29*a*.

The DACs 29*a* to 29*c* convert the 6-bit digital data into analog signals.

The CRT 8 shown in FIG. 1 receives the signals output from the group 29 of DACs and displays various colors.

The operation of the personal computer 100 will now be explained, with reference to the drawings.

Figure 4:
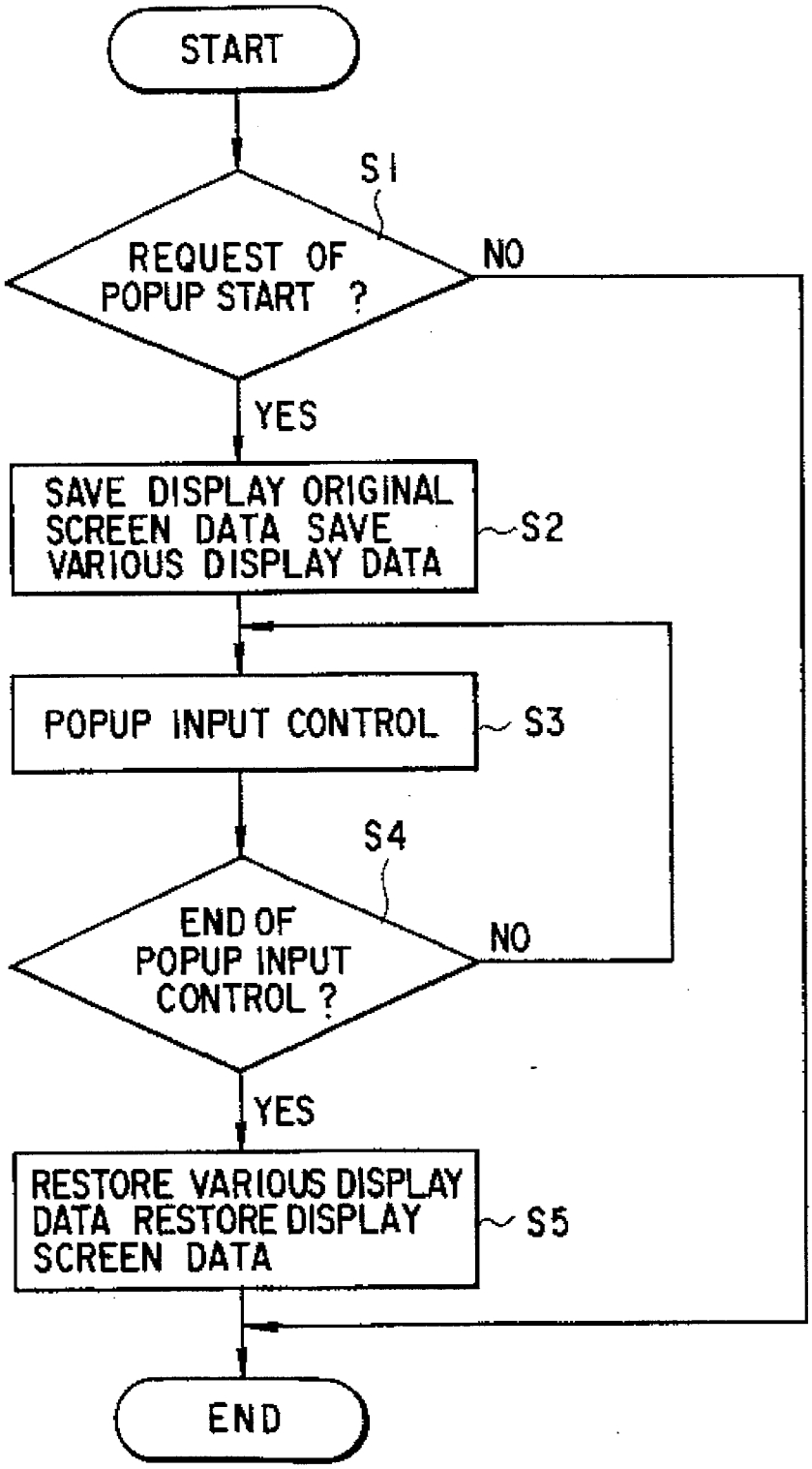
FIG. 4 is a flow chart for explaining the popup activation control performed in an embodiment of the present invention.
Figure 5:
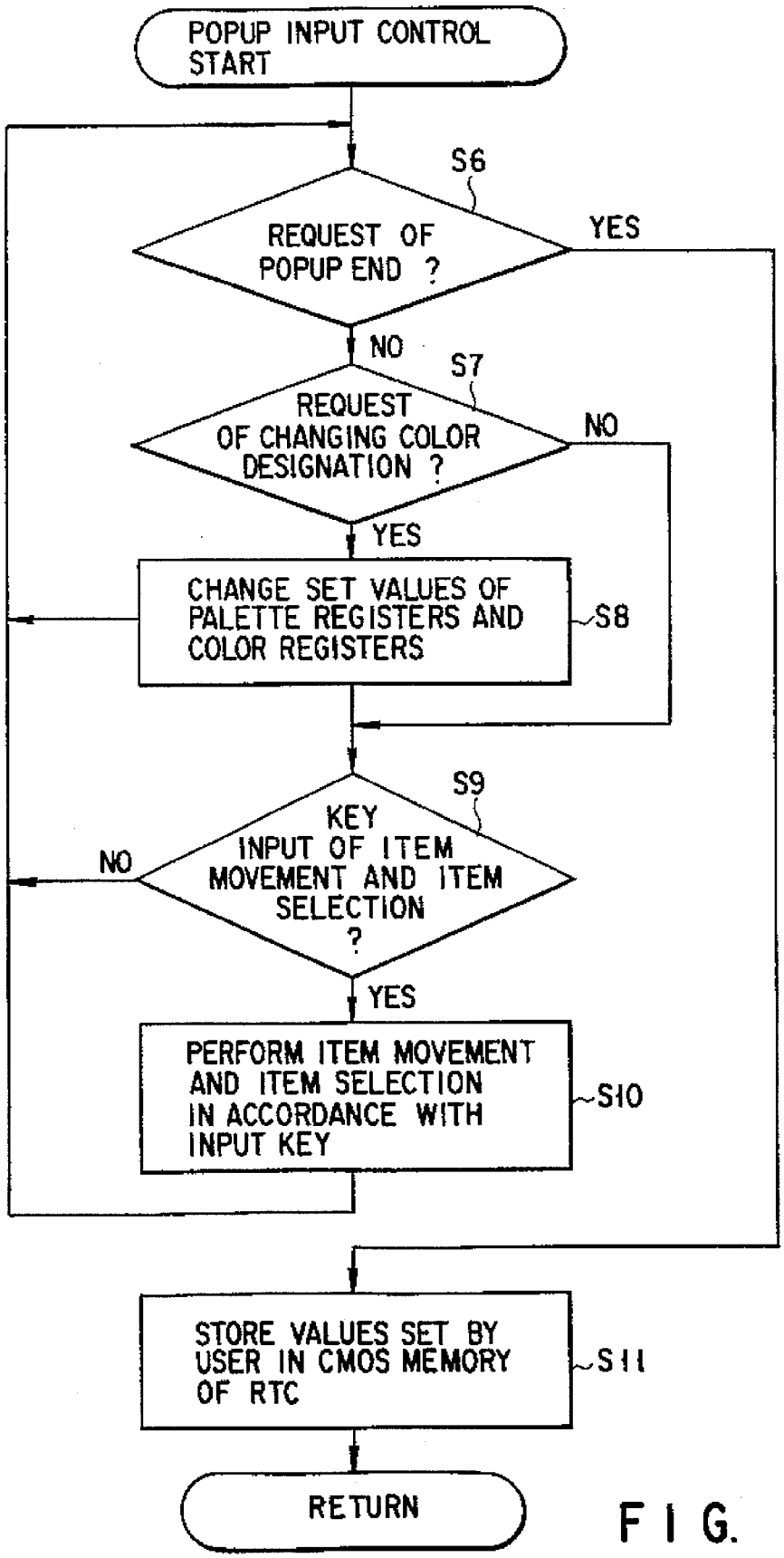
FIG. 5 is a flow chart for explaining the popup input control performed in an embodiment of this invention.

FIG. 4 is a flow chart for explaining the popup activation control, and FIG. 5 is a flow chart for explaining the popup input control.

A timer routine works outside the flow charts of FIGS. 4 and 5. This timer routine repeatedly initiates the popup activation control routine (FIG. 4) stored in the ROM 5 at intervals of about 55 ms.

When the flow shown in FIG. 4 starts, the popup activation routine reads the status of a predetermined bit of the system register 9, thereby determining in step S1 whether a popup activation request has been made or not.

If it is determined in step S1 that no popup activation request has been made, the flow of FIG. 4 ends.

Conversely, if it is determined in step S1 that a popup activation request has been made, the flow goes to step S2.

In step S2, the display data, which will be erased from the screen when the popup menu is displayed on the screen, and various display control data are stored into the backup memory 4, and the display data of the popup menu are written into the VRAM 21. Then, the flow goes to step S3. The display data and the various display control data are stored so, in order to display them again, after the completion of the popup control, in the display mode valid before the popup menu is displayed.

The displaying of the popup menu will be explained as follows.

To display the popup menu, a font code, a background color, and a character color as shown in FIG. 3(*b*), all corresponding to the characters to be displayed, are set in the VRAM 21.

The display controller 7 reads the data stored in the VRAM 21 and selects a palette register in accordance with the data designating the background color and the data designating the character color. (The application has already set default values for the data stored in the group 24 of palette registers and the group 28 of color registers.)

The decoder 27 decodes the data held in the palette register selected, thereby selecting a color register. The group 29 of DACs perform D/A conversion on the data stored in the selected color register.

The CRT 8 displays the popup menu in accordance with the analog signals output from the group 29 of DACs.

When these operations are performed to display the popup menu, however, the popup menu may not be seen in some cases as has been explained above in the "Object of the Invention." For example, when such data as shown in FIG. 3(*b*) is set in the VRAM 21 as data for displaying the popup menu, such data items as shown in FIG. 3(*c*) are set in the palette registers, and such data as that shown in 3(*d*) are set in the color registers, in accordance with the application, the popup menu will not be seen.

More specifically, to display the data shown in FIG. 3(*b*), the palette register of index 0 is selected in accordance with the data "0" representing the background color, and the color register of index 0 is selected in accordance with the data "0" held in the palette register selected. Meanwhile, the palette register of index 7 is selected in accordance with the data "7" representing the character color, and the color register of index 0 is selected in accordance with the data "0" held in the palette register selected. Thus, the color register of index 0 is selected for both the background color and the character color. Consequently, the background and the characters are displayed in the same color, and the popup menu cannot be seen at all.

To solve this problem, popup input control is performed in step S3 in the present invention.

The popup input control will be described in detail with reference to FIG. 5.

In step S6 (FIG. 5), the popup activation control routine reads the status of a predetermined bit of the system dedicated register 9, thereby determining whether a popup termination request has been made nor not. If no popup termination request has been made, the flow goes to step S7.

In step S7, the CPU 1 reads the data (indicating that the Fn key has been depressed) and determines whether a display color alteration request has been input or not. If it is determined in step S7 that a display color alteration request has been made, the flow goes to step S8.

In step S8, the data stored in the group 24 of palette registers and in the group 28 of color registers, which will be used to display the popup menu, are stored in the backup memory 4. Further, the values set in the group 24 of palette registers and the group 28 of color registers are rewritten to predetermined values so that the popup menu may be seen clearly. Then, the flow returns to step S6. In the case of FIGS. 3(*c*) and 3(*d*), the data "0" stored in the palette register of index 7 is changed to "7", and the data "0" stored in the color register of index 7 is changed to "3F."

As a result of this, in order to display the data shown in FIG. 3(*b*), the palette register of index 0 is selected in accordance with the data "0" representing the background color, and the color register of the index 0 is selected in accordance with the data "0" held in the palette register thus selected. In the meantime, the palette register of index 7 is selected in accordance with the data "7" representing the character color, and the color register of index 7 is selected in accordance with the data "7" held in the palette register thus selected. Data "0" and "3F" are set in the color registers of indices 0 and 7, respectively. Therefore, the background color and the character color are different, whereby the popup menu is seen.

If it is determined in step S7 that no display color alteration request has been made, the flow goes to step S9. In other words, if no alteration of the designated color has been requested, the values set in the palette registers are not rewritten, maintaining the display colors of the popup menu.

In step S9, it is determined whether or not any popup-menu item should be moved and whether or not any key has been depressed to select an popup-menu item. If any key of the keyboard 6 has been depressed, the flow goes to step S10.

In step S10, the popup-menu item is moved and an popup-menu item is selected, in accordance with the key depressed. Then, the flow returns to step S6.

If it is determined in step S6 that a popup termination request has been made, the flow goes to step S11.

In step S11, the values input by the user are stored into the CMOS memory 2 of RTC, and the data for controlling the popup termination is read from the system register 9. Thus ends the flow shown in FIG. 5, and the operation goes to step S4 of the flow shown in FIG. 4.

In step S4 shown in FIG. 4, the CPU 1 reads the predetermined bits of the system dedicated register 9, thereby determining whether or not the popup input control has been completed.

If it is determined in step S4 that the popup input control has been completed, the flow goes to step S5.

In step S5, the data displayed on the screen of the CRT 8 before the display of the popup menu and the various display control data items are restored into the VRAM 21 and the like. Then, the flow of FIG. 4 ends.

If it is determined in step S4 that the popup input control has not been completed, the flow returns to step S3, which is performed.

Once the popup menu display is controlled as described above, the popup menu can be displayed and seen clearly in the colors set by the application program.

If the displayed popup menu is hard to see, it can be clearly seen by operating the keyboard 6 (for example, depressing the function key and the escape key), thereby requesting for display color alteration.

The popup menu can be rendered visible no matter whichever color-designating data are held in the palette registers and the color registers in accordance with the application program.

The present invention is not limited to the embodiment described above various changes can be made in the invention.

The embodiment described above is designed such that, when the popup menu is not seen, measures are taken to display the popup menu clearly. Nonetheless, the colors in which the popup menu are displayed can be changed whenever necessary to whichever colors desired.

Furthermore, in order to switch the display screen from the popup menu back to the data-processing screen, the values altered in the group 24 of palette registers and the group 28 of color registers may be replaced by the initial values.

With the above-described embodiment, display color alteration is requested for by operating the function key and the escape key. Instead, it may be automatically determined in the popup-processing routine whether or not the character color and the background color are identical, when the popup activation request is made (by simultaneously depressing the Ctrl key and the Alt key). If the character color and the back ground color are found to be identical, then it suffices to alter the values set in the group 24 of palette registers and the group 28 of color registers.

I claim:

1. A method of controlling display of a window screen on a display screen, for use in a computer system comprising a display memory for storing display data including a font code, a background color code and character color code, palette registers for storing first color-designating data, a digital-to-analog converting circuit having a color register for storing second-color designating data, and display means for displaying the second color-designating data, an index of the palette register being designated by the display data and an index of the color register being designated by the first color-designating data, the method comprising the steps of:

activating the window screen;

determining, in response to the step of activating the window screen, whether a character color corresponding to the character color code, and a background color corresponding to the background color code, displayed on the window screen are identical;

altering, if the character color and the background color are found to be identical in the determining step, at least one of a selected first color-designating data stored in the palette register and at least one of the selected second color-designating data stored in the color register of the digital-analog converting circuit;

converting the second color-designating data to analog signals, to thereby display the character color and the background color on the display screen in accordance with the analog signals.

2. The method according to claim 1, wherein the computer system has a backup memory for storing the display data and storage means for storing data representing activation/termination of the window screen, and the method further comprises the steps of:

determining whether the window screen is to be activated, based on the data stored in the storage means; and saving in the backup memory display data displayed in an area of the display screen which is to disappear in the window screen, when it is determined in the determining step that the window screen is to be activated.

3. The method according to claim 2, further comprising the steps of:

determining whether the window screen is to be terminated, based on the data stored in the storage means; and restoring from the backup memory into the display memory the display data displayed in that area of the display screen which is to disappear in the window screen, when it is determined in the determining step that the window screen is to be terminated.

4. The method according to claim 1, wherein the computer system includes designating means for designating alteration of the color-designating data and storage means for storing the color-designating data, and the method further comprises the steps of:

determining whether the designating means has requested for alteration of the color-designating data; and altering the color-designating data stored in the storage means, when it is determined in the determining step that alteration of the color-designating data has been requested.

5. The method according to claim 4, further comprising the steps of:

arbitrarily selecting input items displayed on the window screen when it is determined that alteration of the color-designating data has not been requested; and saving values indicating the selected input items.

6. The method according to claim 1, wherein the digital-to-analog converting circuit comprises a plurality of blocks each comprising a plurality of color registers, and the computer system further comprises a color select register for selecting one of the plurality of blocks of the digital-to-analog converting circuit, and the method further comprises the step of selecting one of the plurality of blocks of the digital-to-analog circuit to thereby change the second color-designating data by using the color select register, when the determining step determines that the character color and the background color are identical.

7. An apparatus for controlling display of a window screen activated in a display screen, comprising:

means for activating the window screen;

a display memory for storing display data comprising a background color code representing a background color and a character color code representing a character color;

palette registers for storing first color-designating data, an index of the palette register being designated by the display data;

a digital-to-analog converting circuit incorporating color registers for storing second color-designating data, an index of the color register being designated by the first color-designating data;

determining means for determining whether the character color and the background color, when displayed on the window screen, are identical, after the activating means has activated the window screen;

means for altering at least one of a selected first color-designating data stored in the palette registers and at least one of a selected second color-designating data stored in the color registers of the digital-to-analog converting circuit; and means for converting the second color-designating data to analog signals, to thereby display the character color and the background color on the display screen in accordance with the analog signals.

8. The apparatus according to claim 7, further comprising:

a backup memory for storing the display data;

storage means for storing data representing activation/termination of the window screen;

determining means for determining whether the window screen is to be activated, based on the data stored in the storage means; and means for saving in the backup memory the display data displayed in an area of the display screen which is to disappear in the window screen, when the determining means determines that the window screen is to be activated.

9. The apparatus according to claim 8, further comprising:

determining means for determining whether the window screen is to be terminated, based on the data stored in the storage means; and means for restoring from the backup memory into the display memory the display data displayed in that area of the display screen which is to disappear in the window screen, when the determining means determines that the window screen is to be terminated.

10. The apparatus according to claim 7, further comprising:

designating means for designating alternation of the color-designating data;

storage means for storing the color-designating data;

determining means for determining whether the designating means has requested for alteration of the color-designating data; and means for altering the color-designating data stored in the storage means, when the determining means determines that alteration of the designating data has been requested.

11. The apparatus according to claim 10, further comprising:

means for arbitrarily selecting input items displayed on the window screen, when it is determined that alteration of the color-designating data has not been requested; and means for saving values indicating the selected input items.

12. The apparatus according to claim 7, wherein the digital-to-analog converting circuit comprises a plurality of blocks each comprising a plurality of color registers; and a color select register for selecting one of the plurality of blocks to change the second color-designating data, when the determining means determines that the character color and the background color are identical.

* * * * *